US005494718A

United States Patent [19]

Adams et al.

[11] Patent Number: 5,494,718

[45] Date of Patent: Feb. 27, 1996

[54] RIGIDIZER FOR PLASTIC VESSELS

[75] Inventors: Susan K. Adams, Bay Village; M. Timothy Chernock, Avon Lake; Martin Warchola, Medina; Martin E. Woods, Westlake, all of Ohio

[73] Assignee: The Geon Company, Indpependence, Ohio

[21] Appl. No.: 182,896

[22] Filed: Jan. 18, 1994

[51] Int. Cl.[6] ..... B29D 22/00

[52] U.S. Cl. ..... 428/35.7; 428/36.4; 4/538; 4/580; 4/581; 4/584; 4/619

[58] Field of Search ..... 428/35.7, 36.4, 428/412, 475.5, 480, 521, 522, 523; 4/538, 580, 581, 584, 619

[56] References Cited

U.S. PATENT DOCUMENTS

| | | | |
|---|---|---|---|
| 3,870,679 | 3/1975 | Mitchell et al. | 260/45.75 N |
| 4,180,529 | 12/1979 | Hoffman | 525/85 |
| 4,289,717 | 9/1981 | Bortz | 264/46.5 |
| 4,290,154 | 9/1981 | Benjamin | 4/538 |
| 4,341,883 | 7/1982 | Gift | 525/82 |
| 4,598,123 | 7/1986 | Cutter | 525/84 |
| 4,784,904 | 11/1988 | Wood et al. | 428/317.9 |
| 4,844,944 | 7/1989 | Graefe et al. | 428/35.7 |
| 4,868,058 | 9/1989 | Biglione et al. | 428/412 |
| 5,036,121 | 7/1991 | Coaker | 524/100 |
| 5,069,851 | 12/1991 | Hicks et al. | 264/171 |

FOREIGN PATENT DOCUMENTS 0399707 11/1990 European Pat. Off. .

OTHER PUBLICATIONS

Lumaswirl® product literature American National Standards Institute Specification for plastic bathtub unit.

Photograph of Trade Show Display from Fall 1992 Tub & Spa Show.

*Primary Examiner*—James J. Seidleck
*Assistant Examiner*—Michael A. Williamson
*Attorney, Agent, or Firm*—Miles B. Dearth

[57] ABSTRACT

A shaped rigid thermoplastic cradle and leveler for vessels such as sanitaryware is disclosed. The cradle and leveler are separately formed or integrally shaped from a single thermoformed sheet of rigid thermoplastic material. The rigid thermoplastic material has a flexural modulus of at least about 300,000 psi to provide sufficient rigidity in the sidewall of the cradle. The leveler includes an integral floor leveling means for providing a designed pitch so as to conform to the desired pitch of the floor region of the vessel toward the drain hole. The floor region comprises a plurality of tapering, alternating upper and lower contacting regions. Between each adjacent upper contacting region is defined unsupported span regions having the shortest distance between adjacent upper contact regions of not more than 12 inches (30.5 cm). Preferably the shortest distance between adjacent upper contact regions defining the unsupported span is from 2.5 inches to about 6 inches. A variety of rigid thermoplastic materials are adaptable herewith and include acrylonitrile-butadiene- styrene copolymers, styrene-acrylonitrile copolymer, acrylonitrile-styrene-methacrylate copolymers, polystyrene, styrene-alpha methyl styrene copolymers, polyethylene, polypropylene, polycarbonate, and polyvinyl chloride. The most preferred embodiment comprises rigid fiber reinforced polyvinyl chloride.

31 Claims, 10 Drawing Sheets

RIGIDIZER FOR PLASTIC VESSELS

FIELD OF THE INVENTION

The invention relates to structurally supporting articles for plastic vessels including bath tubs, spas, whirlpools, hot tubs, shower stalls, referred to as sanitaryware vessels, as well as industrial wash basins, vessels for liquids or solids and the like, all collectively referred to as tubs.

BACKGROUND OF THE INVENTION

Molded plastic sanitaryware and plastic industrial vessels have experienced steadily increasing sales in the last few decades. Both thermoplastic and thermosetting resins have been employed in the materials used for these products. U.S. Pat. No. 4,267,229, for example, discloses decorative acrylic sheets and formed articles for this purpose. The sheets are of the cast solution methacrylate type formed by polymerizing a monomer mixture in a closed cell. The colored acrylic sheet is formed from polymer in monomer syrup containing a mixture of pigments and the invention pertains specifically to the concentration of pigments towards one surface.

Structurally reinforced composites comprising a thermoplastic vessel such as polymethylmethacrylate and a rigid foam backing of blown polyurethane are disclosed in U.S. Pat. No. 4,784,904. Recycling of the rigid polyurethane foam is not economical.

National standards have been implemented by the plumbing industry through ANSI regulations such as Z124.1 for plastic bath tub units and Z124.2 for shower stalls. Type 4 tubs are defined as units having a thermoplastic sheet material which is formed over a mold and containing a structural base. The sheet material must conform to a variety of performance standards such as impact strength, load strengths at various locations on the article, ignition tests, and others. The present invention pertains to the structural base component.

Increased attention is becoming focused on the flame and smoke characteristics of plastic sanitaryware as permanent installations in commercial or residential buildings. Future efforts to conform these articles to building codes covering permanent installations gives rise to a technical challenge in designing cost effective plastic replacements for conventional porcelain, steel or thermosetting resin-based sanitarywares and which will exhibit reduced flammability and smoke emission.

Rigidity standards under ANSI require a specified performance level for the floor and sidewalls of plastic sanitaryware. There is a maximum allowable deflection under a specified load for the floor and sidewalls. A trend in commercially available polymer-based sanitaryware articles has been to reduce the weight of material comprising the show surface layer, which leads to thinner wall thickness and reduced flexural strength.

Exemplary show surface layers are made from polymethylmethacrylate, polystyrene, gel coat, and thermoset castings from sheet molding or bulk molding compounds. Show surfaces are structurally reinforced by spray-up or lay-up FRP fiber reinforcements underneath. Exemplary thermoset resin in the FRP layer includes glass reinforced unsaturated polyester which present limitations for recycling.

The forming method for spray-up/lay-up is essentially manual, and requires a post-lay-up curing period, during which time volatile organic compounds (VOC) are emitted. With current legislative mandates focusing on the elimination of volatile organic components, this will place greater importance for non-VOC emitting structural components.

It would be desirable from an economic standpoint to enable a reduction in the wall thickness of a thermoformed vessel, substantially eliminating VOC emission, and providing easy recycling without sacrificing rigidity in the structure. The present invention provides such structural support and furthermore is adaptable for reduced flammability and smoke emission for residential and commercial sanitaryware installation. Reusable structural support articles for plastic industrial vessels would also be attractive as replacements for pallets and other supports not as durable for re-use.

SUMMARY OF THE INVENTION

In accordance with the invention there is provided a shaped structural support article for plastic vessels. The structural base component is especially adapted to meet the strength, flexural support and floor orientation especially for vessels (tubs) such as plastic sanitaryware articles.

The shaped rigid structural support article includes a sidewall of minimum height with a circumferential flange and a floor comprising a leveling means. The leveling means in the floor region comprises an interrupted surface provided by a plurality of lower surfaces and upper surfaces contacting the vessel. The floor region provides a designed pitch so as to orient or conform to the pitch in the floor for a desired drainage grade. Between adjacent tub contacting regions in the floor there is defined unsupported span regions between the tub and floor contacting regions. The span is the shortest distance between adjacent upper regions and is not more than 12 inches (30.5 cm). More preferably, the span ranges from 2 inches to about 3.5 inches. The height of the tub contacting region in the plane parallel to the floor gradually diminishes in the direction of the drain hole. The alternating upper and lower regions in the floor are arranged preferably in a repeating pattern of linear parallel channels, or in a radial pattern from the drain hole, or concentric rings, or curved channels or circular spaced depressions forming floor contacting regions. The tub contact regions merge with the sidewall around the floor periphery. A tub contacting region is preferably present in the area surrounding the immediate vicinity of the drain hole. The sidewall must have a thickness, after thermoforming, of at least about 0.060 inches to provide sufficient flexural strength for the tub sidewall.

The preferred article is thermoformed from a single sheet comprising a rigid thermoplastic resin, optionally and preferably from about 2% to 50% by weight dispersed short glass fibers. An impact modified version is preferred. Effective amounts of optional smoke suppressant(s), specified hereinbelow, are preferably incorporated. The most preferred embodiment comprises rigid polyvinyl chloride (PVC) having a molecular weight, in terms of inherent viscosity (I.V.), of from about 0.45 to about 0.8. The sheet has a thickness before thermoforming of from about 0.060 inch to about 0.300 inches. The draw down ratio of initial to final thickness after thermoforming varies from 1:1 to about 1:3.

DETAILED DESCRIPTION OF THE PREFERRED EMBODIMENTS

Figure 1:
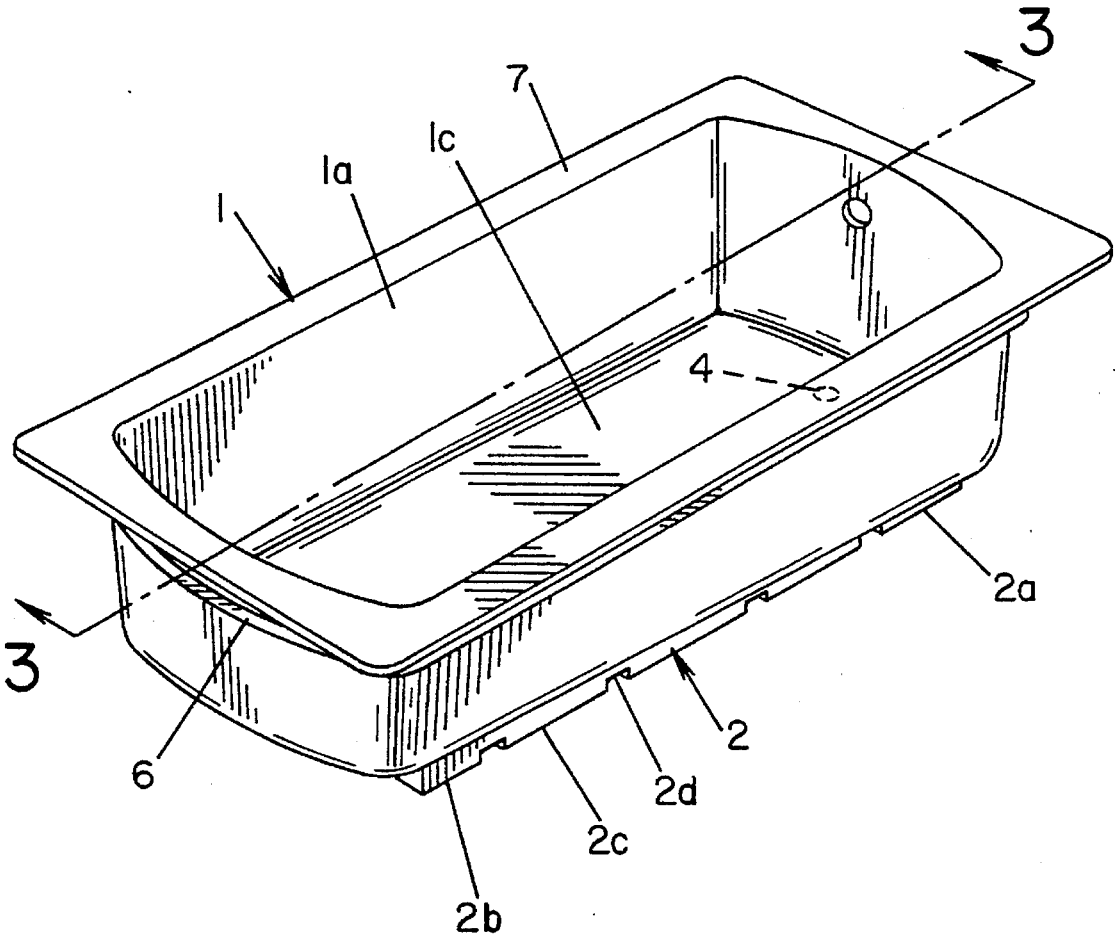
FIG. 1 is a perspective view of an assembled composite in the general shape of a bathtub.

With reference to FIG. 1, depicting an embodiment in the general shape of a bathtub, an assembled sanitaryware article is shown with shaped appearance component 1 having a sidewall height of about 19 inches. Appearance component 1 is placed inside and contacting the structural support article, hereinafter referred to as the rigidizing base component. The rigidizing base component 2 comprises integral cradle with sidewall covering over half of the appearance component and a floor leveler. This appearance component is recognizable as typical sanitaryware other vessels such as large, rotationally molded polyethylene vessels are including with reference to the appearance component. Sanitaryware appearance components are formed, for example, from a thermosetting gel coat, a polystyrene polymer, an acrylic derived from polymethylmethacrylate, polyvinyl chloride, polycarbonate, acrylonitrile-butadiene-styrene, or any rigid single or multilayer thermoplastic or thermosetting material adaptable for providing a smooth, durable vessel. These vessels are generally are non-fiber reinforced, but can be compression molded to provide a smooth surface. A shaped acrylic material is most preferred for sanitaryware, such as embodied in sanitaryware articles sold under the Lumaswirl® trademark of Canada Limited, Richmond Hill, Ontario Canada. Details of making and using show surface materials are disclosed in U.S. Pat. No. 5,069,851 incorporated by reference as if fully disclosed herein. The sanitaryware article is beyond the scope of this disclosure.

Figure 2:
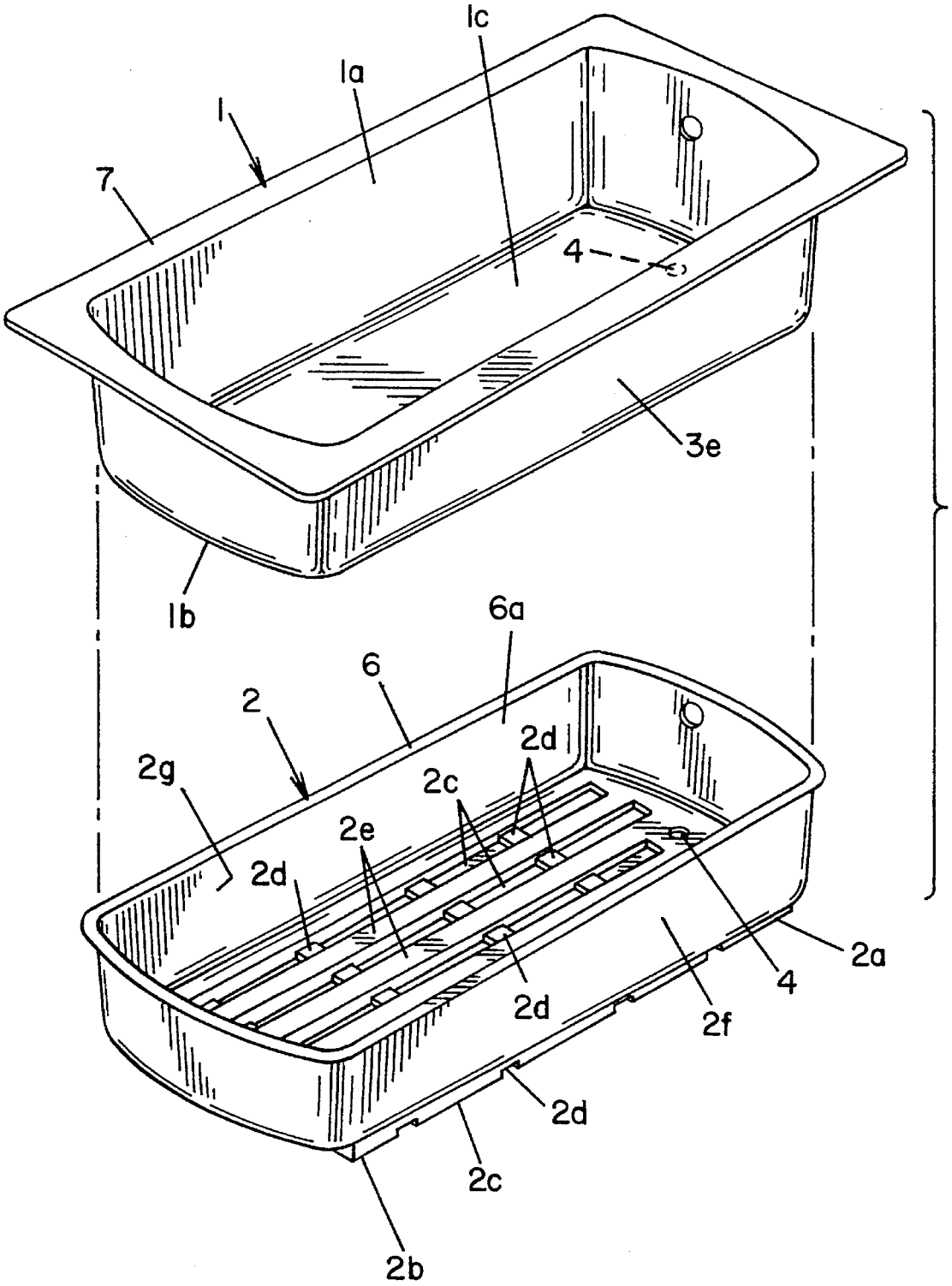
FIG. 2 is an exploded view of the disassembled composite of FIG. 1.

Viewing the lower portion of the base component in FIG. 2 at 2*a* and 2*b*, the proper pitch toward the drain hole at 4 is provided by gradually diminished height from 2*b* to 2*a* in the raised tub contact regions in the floor of the base component. The height of raised tub contacting regions such as at 2*b*, which are furthest from the drain hole should range from about 0.5 inch to about 6 inches whereas the height of the tub contacting regions nearest the drain hole will be 0 inches and up to a height corresponding to the slope and running distance along the floor. The slope defined by the tub contacting surface is constant or variable in a range of from about 1/1000 inch per foot (rise:run) to 10 inches per foot (0.00254 cm. to 25.4 cm. per 30.5 cm.), and most preferably predominantly 0.25 inches per foot which conforms to ANSI 124 standards.

Preferred flange 6 is depicted in FIGS. 1 and 2 as integral with the sidewall of this embodiment of the base component. The flange extends outward substantially perpendicular from the sidewall of the base component. The flange is critical for added structural support in the sidewall and enables a sidewall thickness of 0.060 inches as providing the desired flexural strength for the vessel. Flange 6 extends circumferentially around the sidewall, preferably joining the uppermost end of the base sidewall. Alternatively, the circumferential flange can be separately formed and attached to the sidewall by adhesive, or mechanical fastening means such as with rivets, screws or nut and bolt. An integral flange extending out from the sidewall at least about one inch is most preferred. For larger vessels the flange can extend further. This integral flange is typically the remaining portion of the thermoformed sheet after the area fastened by clamps is trimmed away. The flange portion could extend further to provide support for an outer sidewall of the sanitaryware, if such an outer sidewall is present. FIGS. 1 and 2 illustrate a deck portion 7 on the sanitaryware which does not extend downward forming an outer sidewall, although such an extended deck could be present. In this instance, flange 6 could contact the inner surface of the extended sidewall to provide rigidity there. Integral flange 6 is shown in enlarged fragmentary section in FIG. 5 with optional adhesive 12 joining the sanitaryware component to the inner surface of sidewall 6*a* of the rigidizing base component. Adhesive is preferentially employed in the floor region for sanitaryware.

Figure 4:
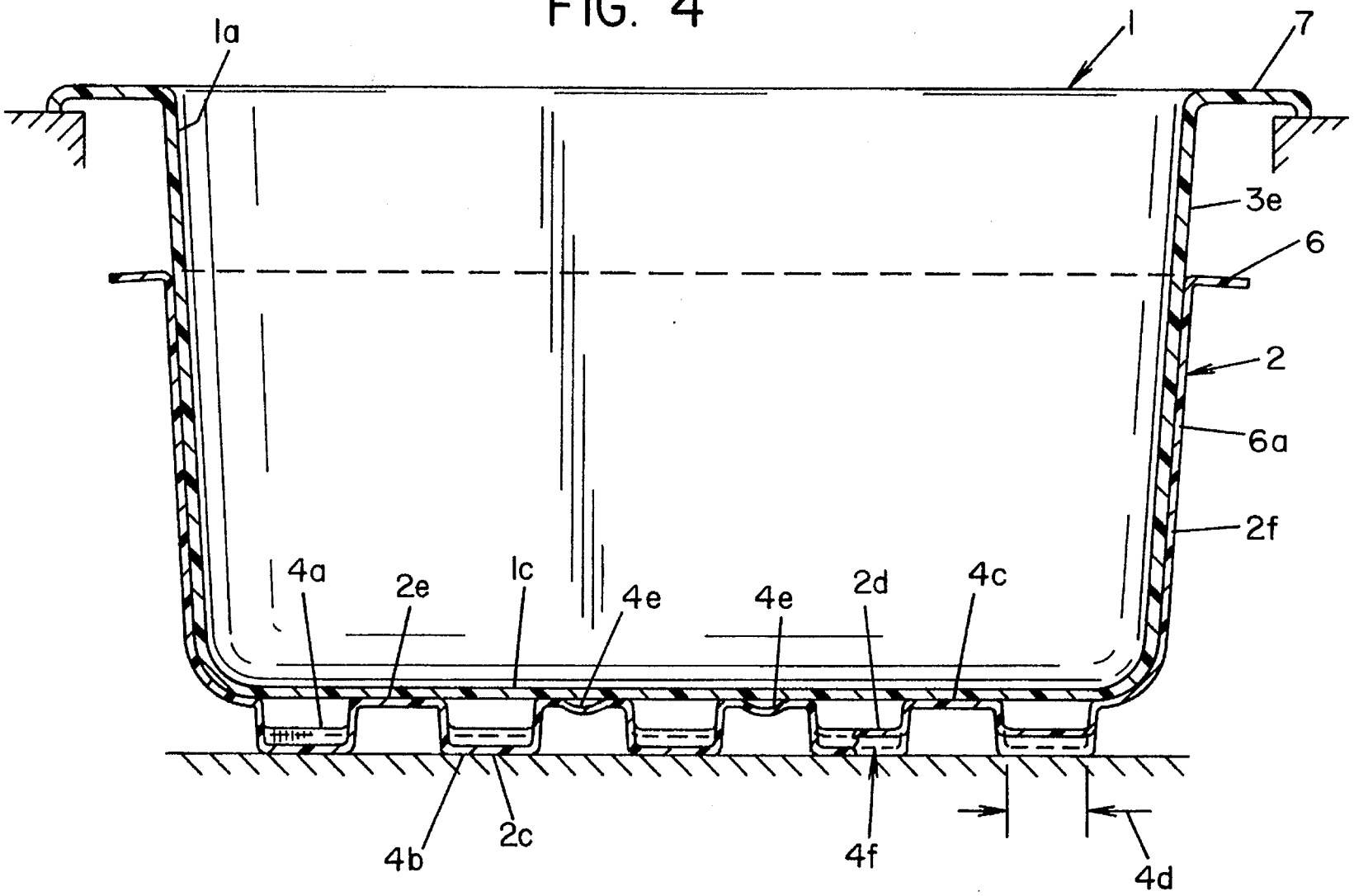
FIG. 4 is a section view of an assembled composite taken on line 4—4 of FIG. 3.
Figure 6:
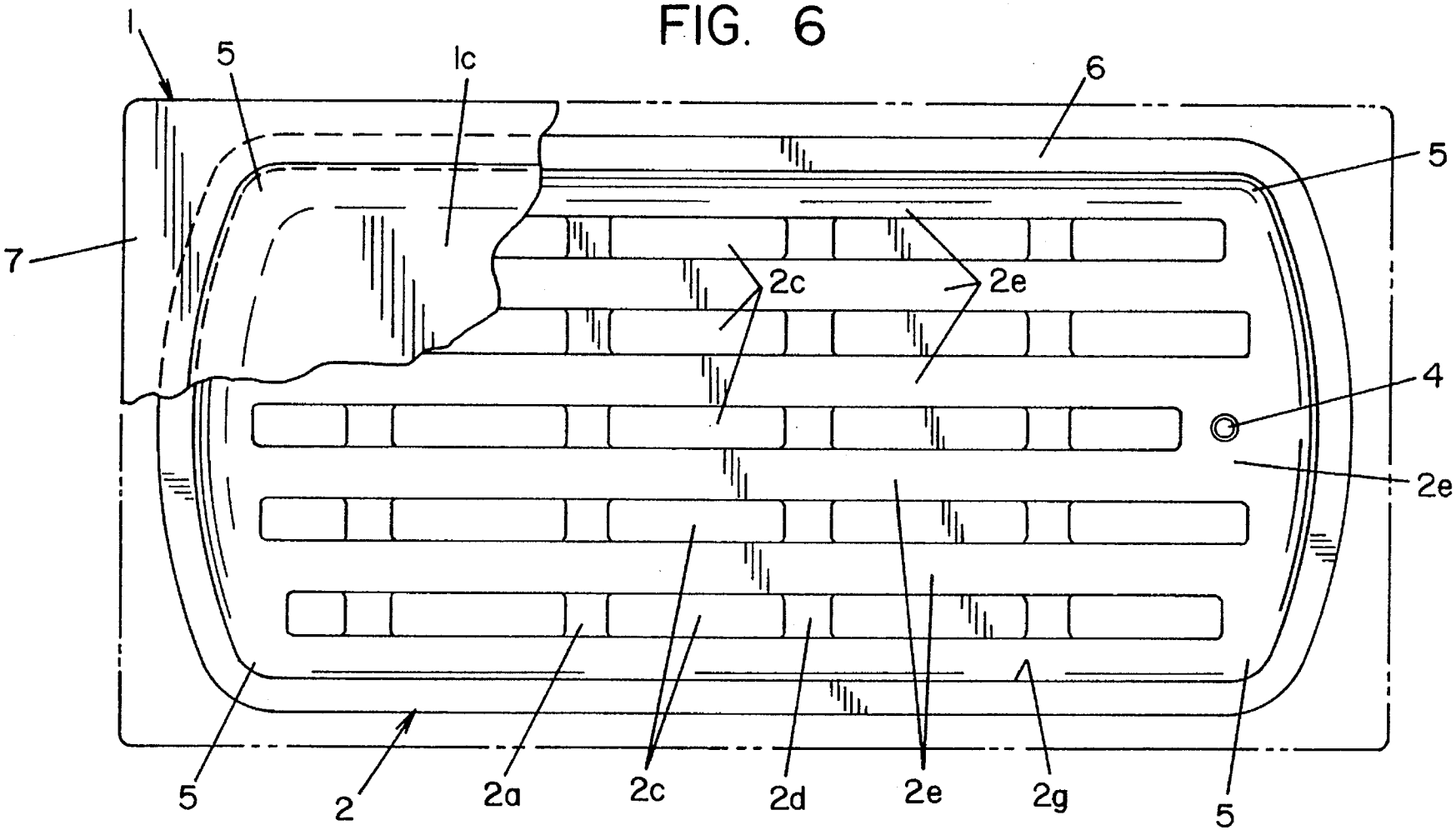
FIG. 6 is a plan view of a rigidizing base component and in the lower left corner, a cut-away of the overlying sanitaryware.

FIG. 2 illustrates a disassembled composite article with the shaped sanitaryware appearance component 1, with underside surface 1*b* which contacts the surface 2*g* of the rigidizing base component. With reference to the base component 2, in FIG. 2, this represents an integral cradle and floor leveler. The "cradle" portion refers to the sidewall and contact areas merging from the tub contacting regions in the peripheral portion of the floor. The "leveler" refers to a pattern of sloping surfaces in the floor of the base component. In a floor pattern containing lineal shaped tub contacting regions it is preferred to incorporate floor reinforcing channels 2*d* extending generally perpendicular to tub and floor contacting regions. The optional floor reinforcing channels preferably are lower in height than the tub contacting regions. This is more clearly seen in FIG. 4 at ref. 4*f* where the cut away reveals a floor reinforcing channel. The floor reinforcing channel at 4*a* therefore preferably may not provide a tub contacting surface. One of the floor contacting regions 4*b*, and one of the tub contacting region at 4*c* are shown in FIG. 4. One of the exemplary unsupported span regions depicted at 4*d* can range in length from 2 inches to 12 inches, but preferably the unsupported spans such as at 4*d* range from 2.5 inches to 6 inches. The more preferred span is from 2 to 3.5 inches, with the most preferred span being 2.5 inches. A span of less than about 2 inches is not as easy attainable by thermoforming methods without a loss of structural strength. Floor contacting regions are shown generally at 2*c* and elsewhere by tracing the surface defined by these regions throughout the floor. Tub contacting regions are shown generally at 2*e* of FIG. 6 and elsewhere by tracing the surface defined by these regions throughout the floor. The floor pattern depicted in FIGS. 2 and 6 is merely preferred in that the floor and tub contacting regions can be shaped to define alternating tub and floor contacting regions in various patterns.

With reference to FIG. 2, the integral cradle and leveler embodiment at 2 contains a sidewall 2*f* which extends upward at least about one fourth or more of the overall height of the vessel sidewall from the tub contacting surface 2*e*. Inner surface 2*g* of sidewall 2*f* contacts the outer surface of the sidewall 2*f* of the vessel article. The base component sidewall extends at least 4 inches upward from the floor. Preferably, sidewall 2*f* terminates in an integral flange 6 at a height of from about ⅓ to ⅔ of the distance from tub floor 1*c* to deck 7, or where the sidewall merges with the uppermost region of the sanitaryware. The surface defined by the inner surface of the sidewalls and tub contacting regions is generally smooth and conforms to the underside surface of the overlying vessel.

Figure 3:
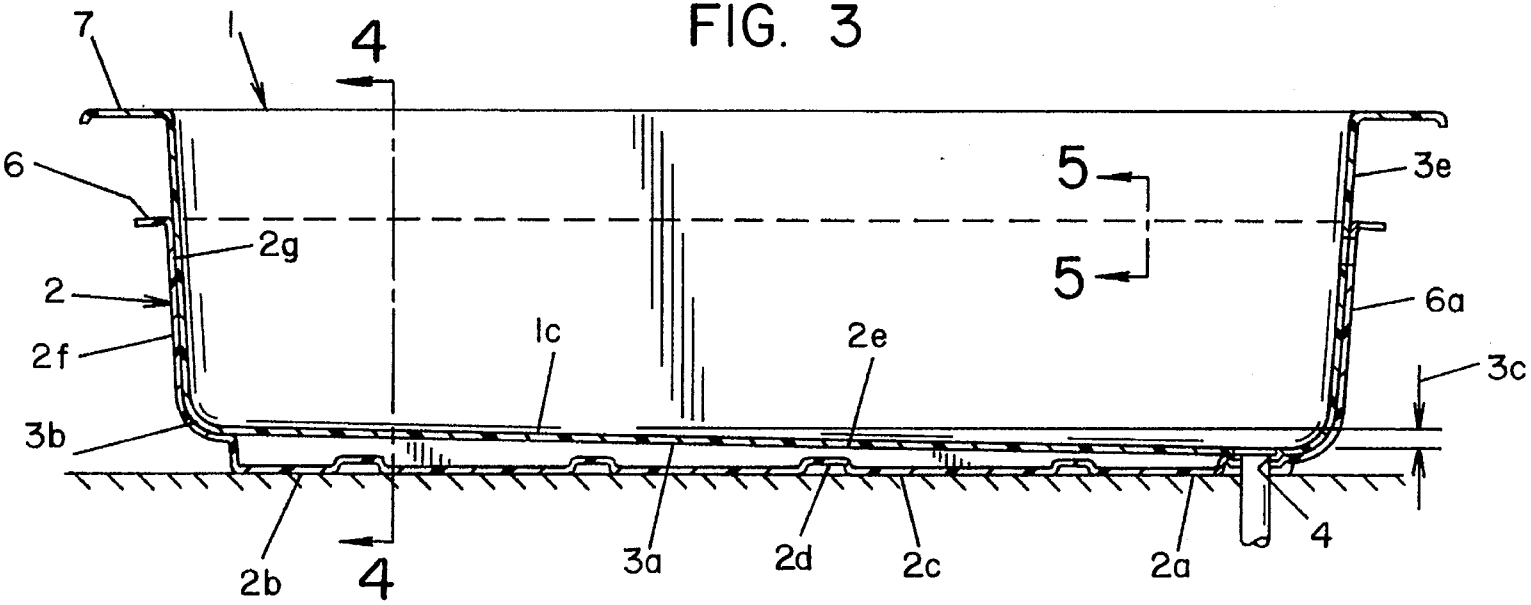
FIG. 3 is a section view of an assembled composite taken on line 3—3 of FIG. 1.
Figure 5:
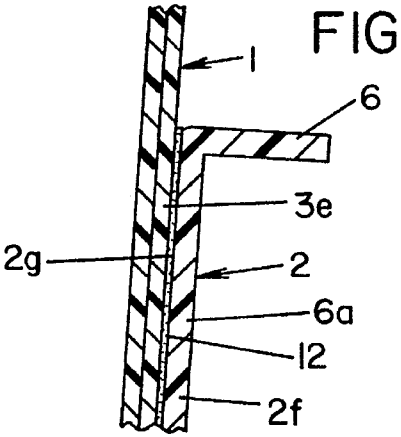
FIG. 5 is an enlarged fragmentary section taken along line 5—5 of FIG. 3.

FIG. 3 is a section view of assembled sanitaryware illustrating a rigidizing base component with an integral cradle and leveler taken on line 3—3 of FIG. 1. There is contact between the appearance component and the reinforcing base component generally all along the sidewall, at the corners 3*b* and in the floor region generally at 3*a*. This contact is essential for providing structural support since the invention is directed to a structural support for tubs which have sidewalls that do not in themselves possess the sufficient flexural strength desired. The angle of slope in the floor is illustrated at 3*c*. FIG. 5 is an enlarged fragmentary section of FIG. 3 taken along line 5—5 of FIG. 3 further illustrating an integral flange/sidewall (6/2*f*) embodiment. Optional adhesive 12 is shown between the sidewall 2*f* of the base and the sidewall 3*e* of the sanitaryware. Sidewall 3*e* is shown as a multilayer embodiment but a single layer is also contemplated for the appearance component, and is beyond the scope of this disclosure.

Figure 7:
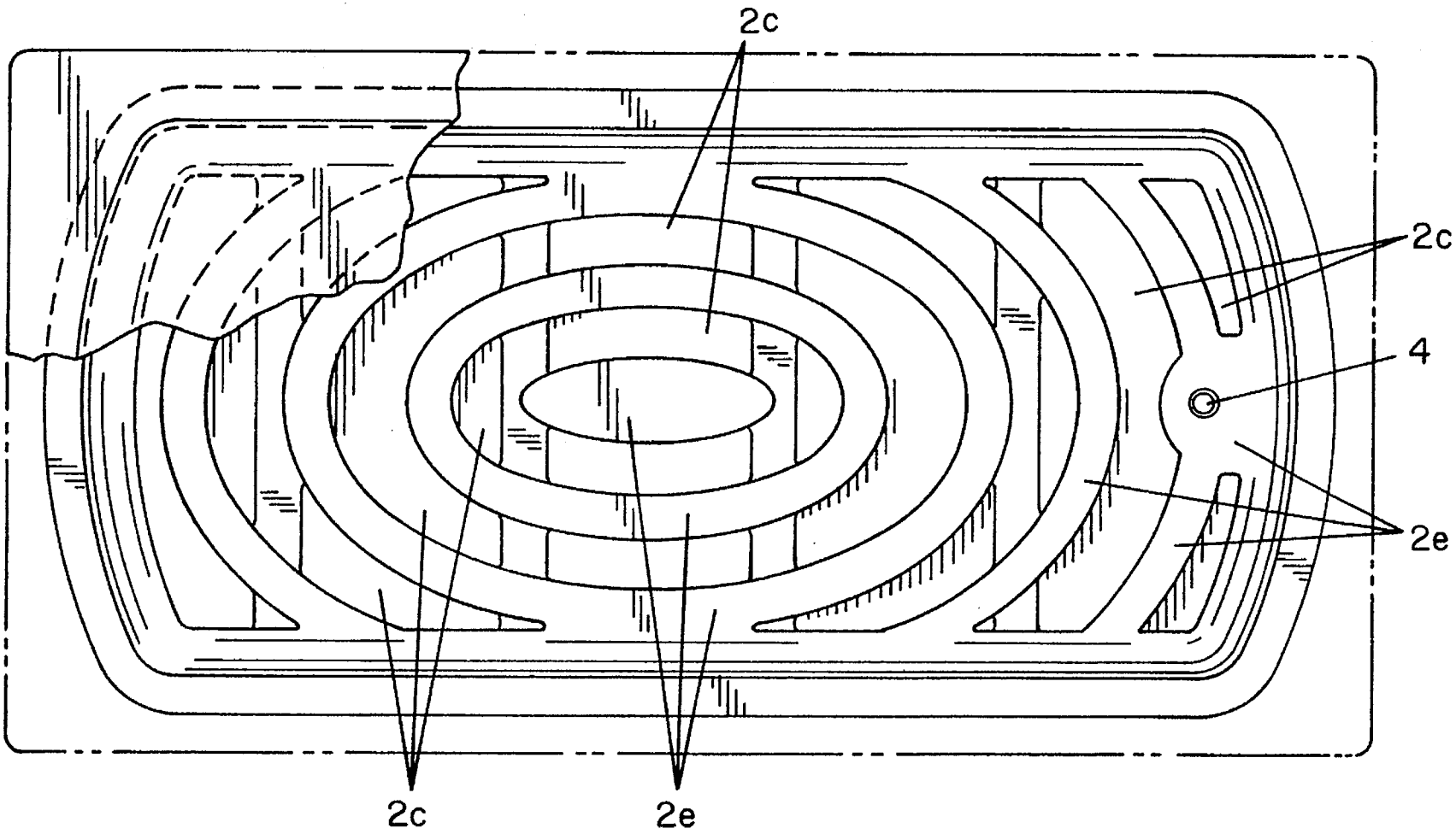
FIG. 7 is a plan view of a rigidizing base component containing curved concentric tub and floor contacting regions, and in the lower left corner, a cut-away of the overlying sanitaryware.

For vessels having an overall square, circular, polygonal or oval shaped floor pattern, where the drain hole might be preferably located toward the center of the floor, the floor and tub contacting regions can be designed in an arrangement of circular depressions forming floor contacting regions with the raised intervening regions forming tub contacting regions, or vice versa, analogous to a flattened dimple pattern but incorporating a sloping tub contacting surface as defined herein. The diameter of circular floor contacting regions should not exceed 12 inches, with the preferred diameter ranging from 2.5 inches to 3.5 inches. Therefore, the circular unsupported span regions defined by the space above the circular floor contacting regions should not exceed 12 inches in diameter. Linear floor and tub contacting regions can also be arranged in a radial pattern converging to a central tub contacting region about the drain hole. An oval pattern of tub and floor contacting regions is depicted in FIG. 7. The patterns illustrated in the figures herein are merely illustrative and are preferred for a sanitaryware article having the dimensions of a conventional bathtub.

Optional grooves or depressions are preferably present in the upper contact surface of one or more tub contacting regions for depositing a bead of bonding adhesive, which is the preferred means for joining a rigidizer to the vessel. With reference to FIG. 4, two tub contacting regions are shown where adhesive is applied enabling adhesion as well as flush contact between the tub contacting surfaces when the tub is placed down into the cradle/leveler during assembly. Adhesive is preferable for permanent sanitaryware assemblies but may not be preferred for reinforcing base components used for supporting industrial vessels. In these applications, it may be advantageous to disengage the vessel with the base component for easier handling during cleaning, or when the vessel is discarded and the base component is re-used.

FIG. 6 illustrates a plan view of the floor for the rigidizing base component having a pattern of tub contacting regions at 2*e* and floor contacting regions at 2*c*. In the vicinity of drain hole 4, the surface is most preferably a tub contacting region. In the corner regions at 5, and elsewhere where floor and sidewall converge there is also most preferably a tub contacting region.

With reference to FIG. 7 there are curved tub contacting regions 2*e* and curved floor contacting regions 2*c* generally in a concentric oval pattern. The tub contacting regions converge at the corners to form a transition to the sidewall. Floor reinforcing channels at 7*a* are preferably present.

Figure 8:
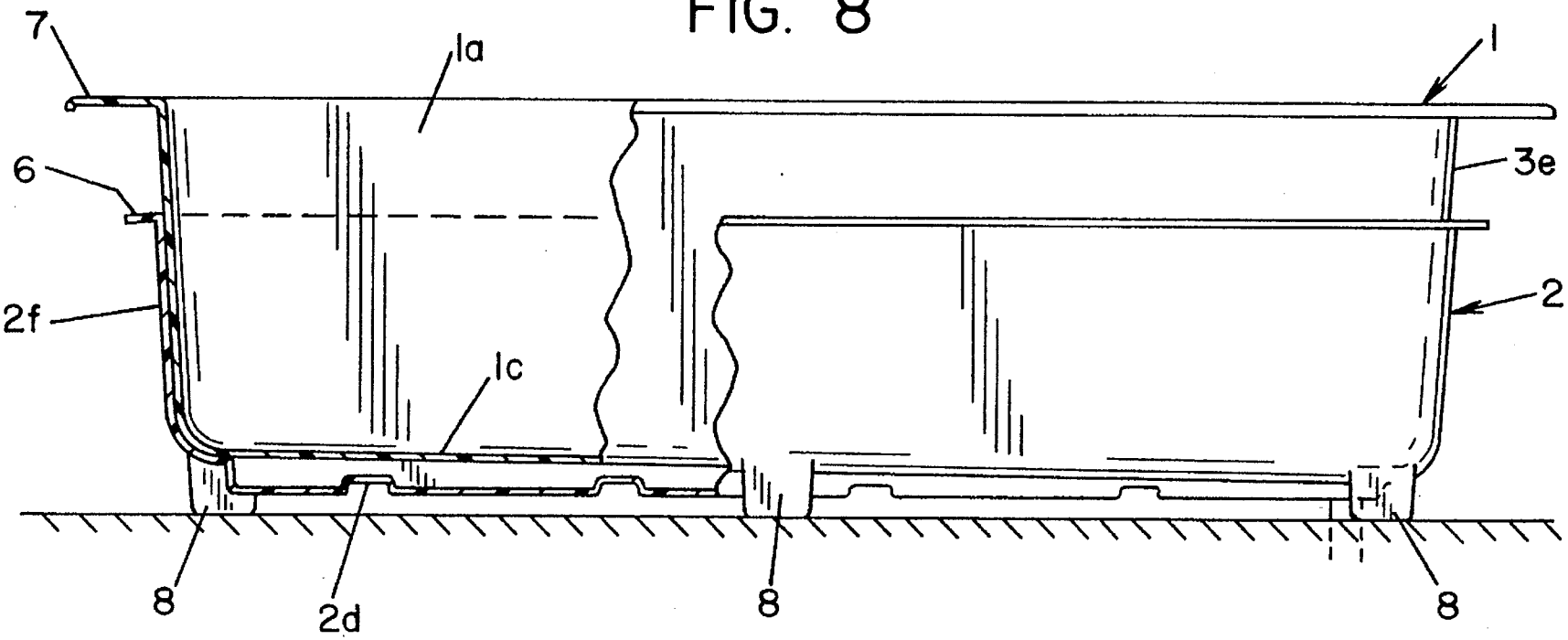
FIG. 8 is an elevation view of an assembled composite with a cut-away portion showing a section view.

With reference to FIG. 8, an elevation view of an assembled sanitaryware composite is shown with a base component 2 having a floor region elevated from the ground by including feet 8 in the corners and in the center region. Feet may be preferred when a bottom drain with access to a drain valve is desired. Feet may not be as desirable for side draining vessels or vessels with no drain. The design shown in FIG. 8 wherein the floor of the base component contains a repeating pattern of raised tub contacting regions provides sufficient rigidity with at least five feet, and the span between feet can exceed 12 inches for some applications.

Figure 9:
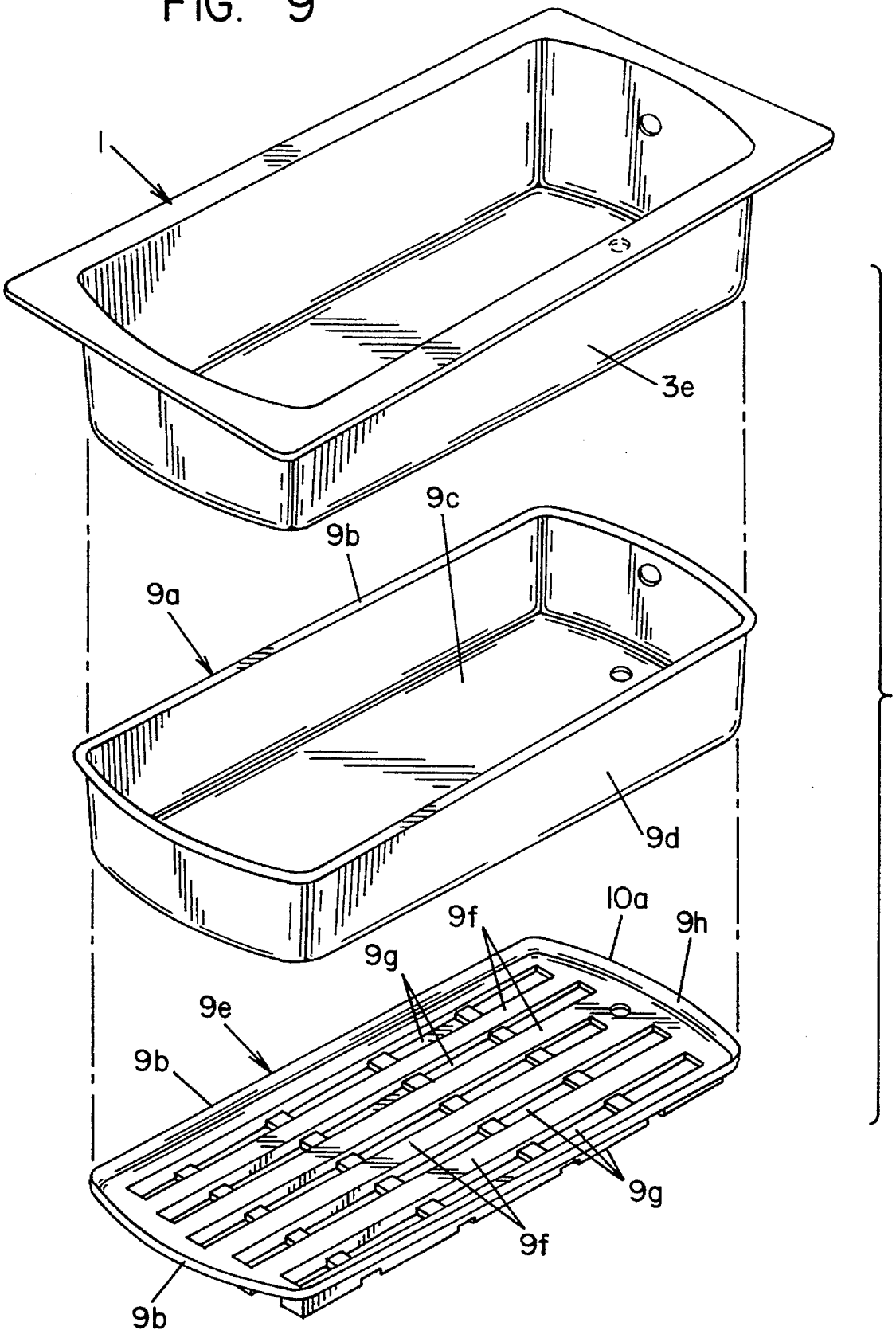
FIG. 9 is an exploded view of a composite depicting an overlying sanitaryware in the shape of a tub, and a two-component leveler/cradle rigidizer.
Figure 10:
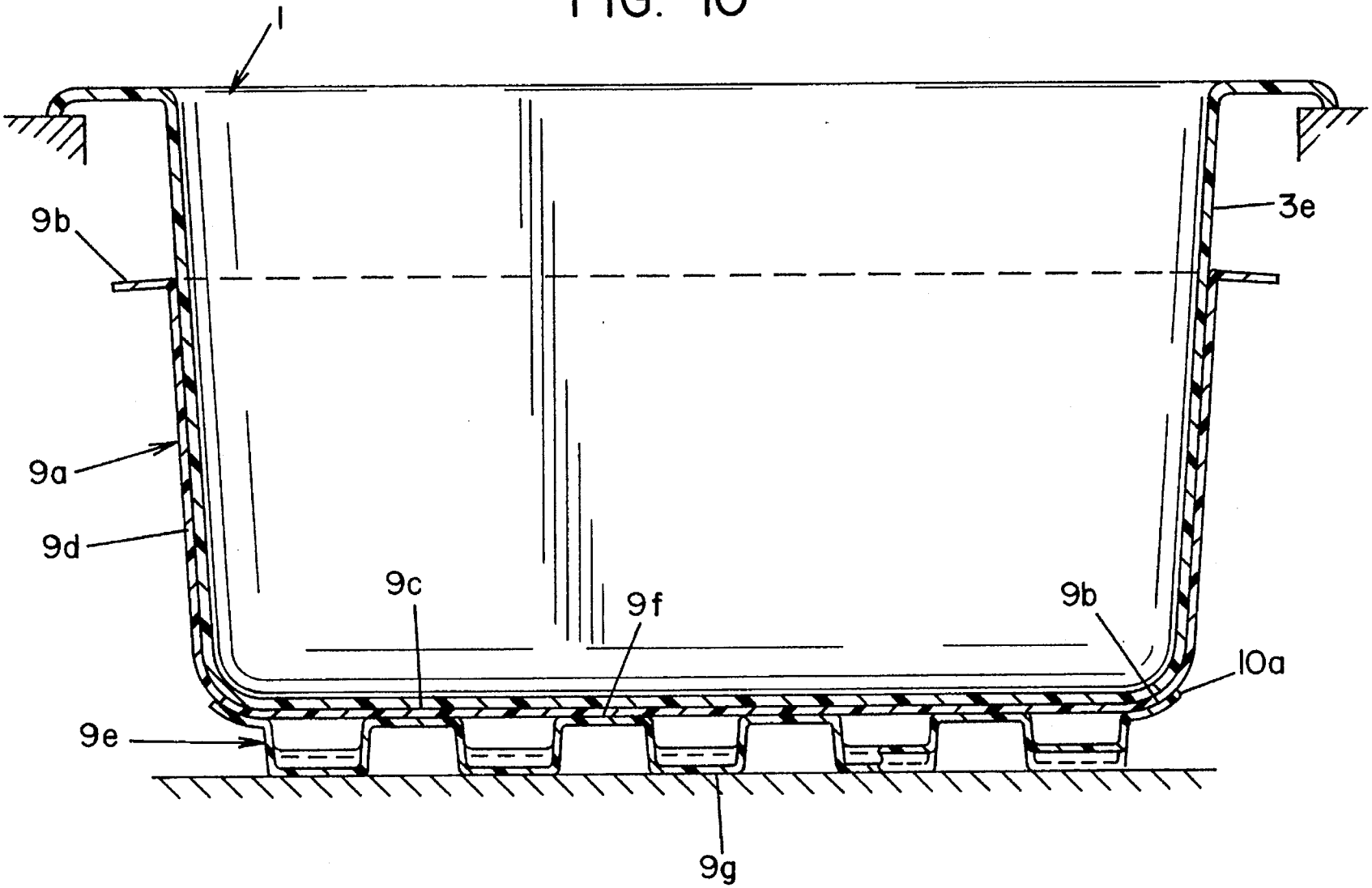
FIG. 10 is a section view of an assembled composite as depicted in FIG. 9 illustrating lateral edges of a leveler terminating in a upward curve, supporting the corners of the cradle.
Figure 11:
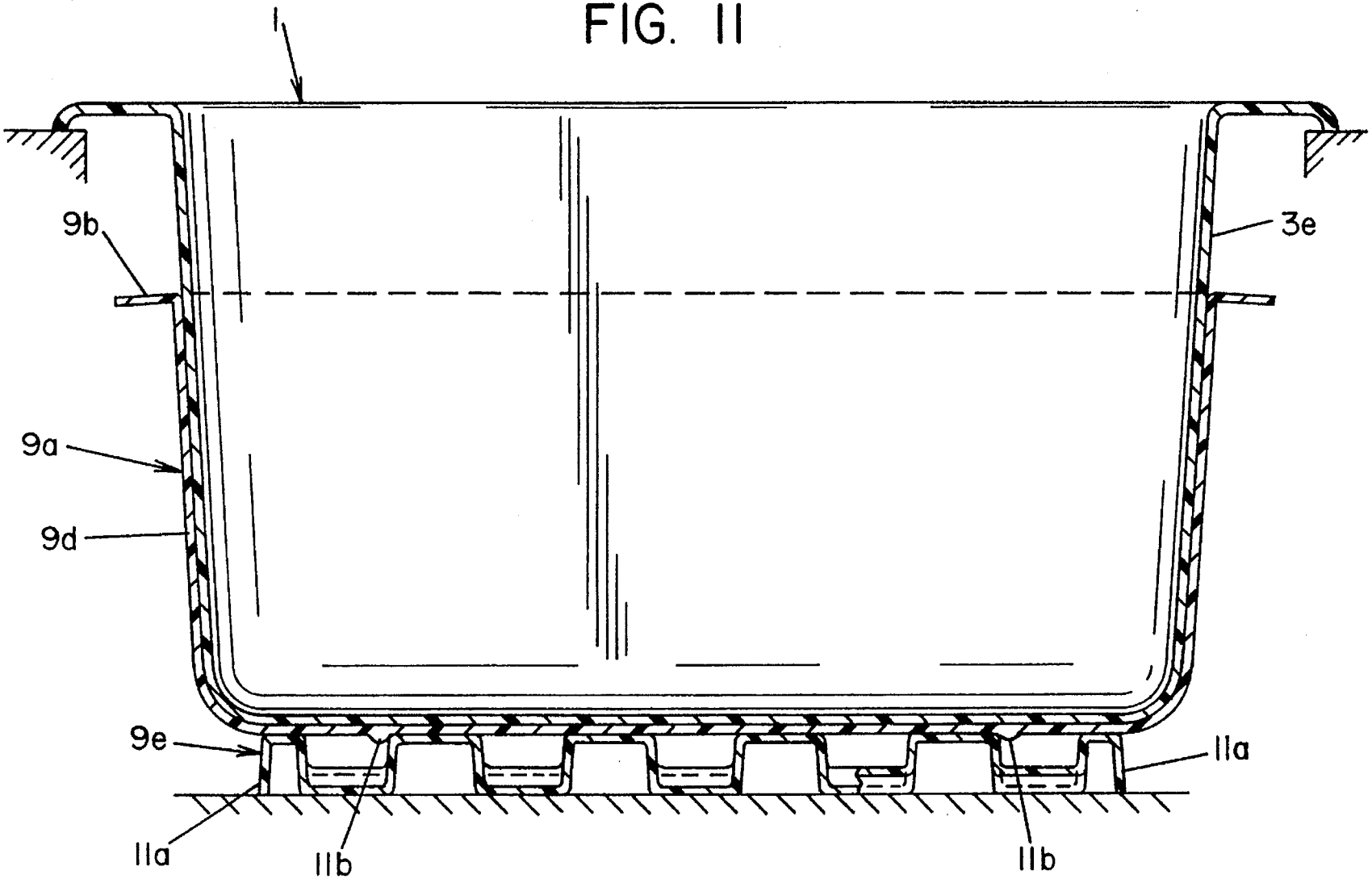
FIG. 11 is a section view of an assembled composite illustrating lateral edges of a leveler terminating at the floor.

With reference to FIGS. 9, 10 and 11, base components are shown comprising a separate floor leveler and a cradle. Such an embodiment is preferred for large vessels having a sidewall height of 3 feet or more. In FIG. 9, an exploded view shows vessel 10, cradle 9*a*, flange 9*b*, a smooth, continuous cradle floor 9*c*, and a sidewall 9*d* which extends from ⅓ to about ⅔ of the height of the sidewall 3*e*. A floor leveler 9*e* contains cradle contacting regions 9*f*, floor contacting regions 9*g*, a short sidewall 9*h*, and floor reinforcing channels 9*i*. Floor reinforcing channels 9*i* can be adapted as larger channels for accepting forks from an industrial fork lift. This allows easy transporting of the vessel. The cradle and leveler are preferably composed of the same material. The sidewall 9*h* extends upwards to contact the corner of the cradle but is terminated at 10*a* preferably after curving around and supporting the corners of the cradle. The sidewalls of the cradle 9*a* extend most preferably up to about ½ of the height of the vessel sidewall.

With reference to FIG. 10 there is shown vessel 10, cradle 9*a* with sidewall 9*d* and flange 9*b*, leveler 9*e* has lateral edge 10*a* which terminates partially around the corners of the cradle.

With reference to FIG. 11 there is shown vessel 10, cradle 9*a* with sidewall 9*d* and flange 9*b*, leveler 9*e* and a lateral edge 11*a* which terminates at the ground. With a cradle having sidewalls, in contact with a leveler, the leveler can terminate at the floor as shown and provide a more stable support in the peripheral portions of the floor. Ref. 11*b* illustrates an optional centering means for controlling the position of the leveler with respect to the cradle. The centering means can be a protrusion or depression on either the cradle, the leveler or both as in a lock-key engagement.

SHEET MATERIALS

It is necessary for the sidewall to extend at least ¼ of the height of the sanitaryware sidewall due to the reduced sidewall thickness of the shaped show-surface component. The invention is practiced most advantageously for sanitaryware articles having a sidewall height at least 12 inches, and more typically 20 to 36 inches.

A rigid thermoplastic must be used for the structural supporting base component. The level of modulus must be at least 300,000 p.s.i. per ASTM-D648 in the thermoplastic resin itself, absent any reinforcing materials, in order to provide sufficiently low deflection in the sidewall and floor with a cost effective amount of sheet material. Such a minimum rigidity is needed also in order to enable the formation of a sheet which has a thickness allowing for the variable draw-down in the shaping process for the integral cradle and leveler embodiment. In an alternative embodiment where the cradle is separately formed, the cradle has a smooth floor. The leveler which supports this cradle underneath is separately formed therefore sheet material is not drawn with the sidewall. Materials which have flexural moduli of up to 1,600,000 psi can be used. The essential composite rigidity is obtained by a variety of thermoplastic resins used in the structural support article. Suggested commercially available thermoplastic resins suitable for use are acrylonitrile-butadiene- styrene copolymers, styrene-acrylonitrile copolymer, acrylonitrile-styrene-methacrylate copolymers, polystyrene, styrene-alpha methyl styrene copolymers, polyethylene, polypropylene, polycarbonate, polyvinyl chloride, chlorinated polyvinyl chloride, styrene maleic anhydride, polybutylene terephthalate, and nylon.

Polyvinyl chloride is most preferred sheet material and exhibits a flexural modulus of at least 300,000 psi without reinforcement. Preferred are homopolymers or copolymers with no more than about 10% comonomer content. The most preferred base component comprises fiber-reinforced rigid PVC. The molecular weight of PVC in terms of Inherent Viscosity (I.V.) per ASTM D1925 should range from 0.45 to 0.8. The most preferred molecular weight in I.V. is from 0.50 to 0.60. The most preferred glass fiber reinforcement material is chopped glass fibers having a diameter of from about 8 to 25 microns and length before use of from 1 to 20 mm. Examples of suitable glass fibers include the various commercial glass fiber types, such as E-glass, with or without coupling agents incorporated thereon. Coupled glass fibers are preferred because of improved strength properties in the composite. Preferred glass fiber dimensions range from 10 to 13 μm diameter and 1 to 8 mm lengths. Chopped glass fibers within these dimensions are commercially available. Optional platelet reinforcement material can be incorporated in the rigidizing base component, but this is less preferred. Optional particulate filler such as calcium carbonate can be included. The preferred optional platelet reinforcement is talc, mica or wollastonite. The most preferred rigidizing base component embodiment contains solely glass fibers as the reinforcing means present at around 20 weight percent on weight basis of the rigidizing base component. If less than 10% glass fibers are used, greater sheet thickness is needed requiring increased material costs to provide sufficiently low sidewall deflection, and if more than about 25% glass fibers are used there is difficulty in processing a higher viscosity extrudate. Within the 10% to 25% weight percent reinforcement level, a sheet made therefrom will have a flexural modulus ranging from about 600,000 psi to about 1,200,000 psi.

It is preferred but not essential that if glass fibers are used that they be treated prior to use with a coating on sizing containing a coupling or bonding agent to assist joining of the thermoplastic to the individual glass filaments. Preferred for acidic polymers such as polyvinyl chloride are amine, diamine or polyamino organosilane coupling agents. Examples of suitable silanes are found in U.S. Pat. Nos. 2,563,288; 2,563,589, 3,318,757 and 4,536,360 incorporated herein by reference. Glass fiber treated with silane coupling agent is available commercially in chopped strand form.

In the most preferred embodiment the rigidizing base component contains generally from 1 weight part to 50 weight parts per hundred of rigid thermoplastic of at least one finely dispersed smoke suppressant compound containing at least one element selected from the group consisting of molybdenum, iron, copper, zinc, vanadium, lithium, sodium, potassium, magnesium, calcium, barium, zirconium, manganese, antimony, phosphorous, aluminum, chromium, boron, tin and titanium including mixtures. Examples of these acting as smoke suppressants include but are not limited to CuS, $Cu_2S$, $Cu_3N$, $SnS_2$, $MoB_2$, FeS, $Cr_2S_3$, TiB, $AlB_{12}$, $Mg(OH)_2$, $2ZnO{\cdot}3B_2O_3{\cdot}3.5H_2O$, zinc borate, $Al_2O_3{\cdot}3H_2O$, $Sb_2O_3$, $K_2MoO_4$, $Li_2MoO_4$, $BaMoO_4$, $MoO_2$, $MoO_3$, $Mo_2O_5$, $Mo_2O_3$, $MoS_2$, $MoS_3$, $MoS_4$, ZnO/MgO, ZnO/MgO/CaO, $Na_2Sb_2O_6{\cdot}5H_2O$. The preferred smoke suppressant system contains either molybdenum, copper, zinc, aluminum, boron, phosphorous, calcium, or mixtures.

Additional smoke suppressants suggested include antimonates such as sodium antimonate ($NaSbO_3$), antimony trioxide ($Sb_2O_3$), halo-substituted alkyl phosphates like tris(2,3-dibromopropyl) phosphate and tris(2,4,6-tribromophenyl) phosphate, and inorganic or organo-molybdenum compounds. Molybdenum compounds include molybdenum dioxide ($MoO_2$), molybdenum trioxide ($MoO_3$), as well as metal molybdate salts including ammonium dimolybdate, $[(NH_4)_2MoO_7]$; ammonium heptamolybdate, $[(NH_4)_6MoO_7O_{24}{\cdot}4H_2O]$; ammonium octamolybdate, or AOM, $[(NH_4)_4Mo_8O_{26}]$; ammonium decamolybdate, $[(NH_4)_2Mo_{10}O_{31}]$; sodium molybdate, $[Na_2MoO_4]$; calcium molybdate, $[CaMoO_4]$; zinc molybdate, $[ZnMoO_4]$; and the like optionally treated with an extender, for example, barium sulfate, calcium sulfate, calcium carbonate, magnesium carbonate, zinc carbonate, silicas, clay, mica, pumice, alumina, and aluminum trihydrate extender. With regard to extended forms of smoke suppressants, the active ingredient may be affixed to support or extender particles in the form of a coating of the active ingredient on the surfaces of the extender particles, as examples: hydrated alumina, barium sulfate, calcium sulfates like gypsum, terra alba, and plaster of paris, calcium carbonate, magnesium carbonate, zinc carbonate, silicas including quartz and diatomaceous earth, talc, soapstone, kaolin clay, mica, pumice,and the like. Calcium carbonate, hydrated alumina, silica and talc are preferred optional extender particles.

Inorganic molybdenum-metal compounds suggested include, for example sodium molybdate, potassium molybdate, barium molybdate, lithium molybdate, calcium molybdate, cadmium molybdate, molybdenum carbonyl, molybdenum disulfide, ammonium paramolybdate, dimeric ammonium 5-molybdocobaltate, ammonium 6-molybocobaltate, ammonium 9-molybdonickelate, ammonium 6-molydonickelate, ammonium 6-molybdoaluminate, ammonium 6-molybdichromate, ammonium 6-molybdoferrate, molybdendyl acetylacetonate.

Organo-molybdenum compounds include molybdenum salts of carboxylic acids as acetates, buryrates, chelates such as acetylacetonates, and organo-amine molybdates. Embodiments of organo-amine molybdate can be prepared for example by the treatment of an organo-amine with $MoO_3$, molybdic acid or a molybdenum salt such as ammonium molybdate, ammonium dimolybdate, ammonium heptamolybdate (also known as ammonium paramolybdate), ammonium octamolybdate, sodium molybdate, ammonium dimolybdate, ammonium heptamolybdate, sodium molybdate, and the commercial "molybdic acid" which primarily consists of one or more ammonium molybdates. The preparation of organo-amine molybdates is described in U.S. Pat. No. 4,053,451 which is incorporated herein by reference.

Organo-amine molybdates represent a preferred class of molybdenum compounds. Organic amines suitable for preparing the organo-amine molybdates may contain from 1 to 40 carbon atoms and from 1 to 10 primary, secondary or tertiary amine groups or a mixture thereof; more preferably from 1 to 20 carbon atoms and 1 to 4 primary amines or heterocyclic secondary amine groups. Examples of organo-amines include aliphatic, alicyclic, alkaryl, aralkyl, aromatic and heterocyclic amines. Aliphatic amines include ethylamine, ethylenediame, 1,2-propanediamine, 1,7-heptanediamine, 1,8-octanediamine, 1,10-decanediamine, 1,12-dodecanediamine and the like. Also included are aliphatic polyamines such as diethylenetriamine, triethylenetetramine, bis(hexamethylene) triamine, 3,3'-iminobispropylamine, quanidine carbonate, and the like. Other suitable amines include alicyclic diamines and polyamines such as 1,2-diaminocyclohexane, 2',4-diamino-1-propyl-4-methylcyclohexane, and the like; aromatic amines as aniline, and naphthylamine; and heterocyclic amines such as melamine, N,N-dimethylaniline, pyridine, piperazine; hexamethylenetetramine; 2,2,3-trimethyl decahydroquinoline, 2,4,6-tri(morpholino)-1,3,5-triazine; and N-(aminoalkyl)-piperazines wherein each alkyl group contains from 1 to 12 carbon atoms, more preferably 1 to 6 carbon atoms, such as N-(2-aminoethyl)piperazine, and the like. Examples of suitable polymeric amines include polyethyleneimine, polyvinylpyridine, polyvinyl pyrrolidine, and poly(2,2,4-trimethyl-1,2-dihydroquin-olyl). Excellent results are obtained using melamine, piperazine, and alkyl amines wherein the alkyl contains 1 to 8 carbon atoms.

Useful melamine and substituted melamines have the formula:

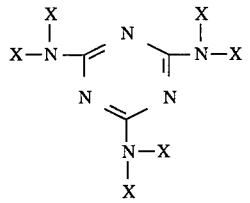

wherein X is hydrogen or an alkyl, alicyclic, aralkyl, alkaryl, aryl or heterocyclic group containing from 1 to 20 atoms of C,O,S and/or N. Two X's on each of one or more nitrogen atoms may also be joined together to form a heterocyclic ring such as a morpholino group in 2,4,6-tri(morpholino)-1,3,5-triazine. Other examples of suitable substituted melamines include N,N',N"-hexaethylmelamine; 2-anilino-4-(2',4'-dimethylanilino)- 6-piperidino-1,3,5-triazine; and 2,4,6-tri(N-methylanilino)-1,3,5-triazine. The organo-amine molybdate normally contains from about 1 to 2 moles of molybdenum per mole of amine.

Melamine molybdates are most preferred organoamines. Melamine molybdate can be prepared in aqueous formic acid as follows: 10 grams of melamine, 7.30 grams of formic acid, and 250 ml water are dissolved together by refluxing in a 500 ml. round-bottomed flask equipped with a stirrer and water-cooled condenser; 26.95 grams of ammonium dimolybdate are dissolved in 50 ml. hot water and then added to the first solution. A white precipitate forms immediately. room temperature (about 25° C.), and filtered through Whatman No. 42 filter paper that is backed by a Macherey, Negel and Company (Duren, Germany) MN-85 filter paper supported on a Buchner funnel. A white solid is recovered and washed three times with water. The solid is vacuum dried for 3 hours at 120° C.

The organo-amine molybdates may be in the form of polycrystalline or amorphous fine powders. Molybdate powders useful herein generally will have a median diameter of less than 25μ, preferably less than 5μ, more preferably less than 3μ, and most preferably less than 2.6μ. Treatment with a particle refining process to remove outsized particles leads to better physical properties in the sheet. The most preferred smoke suppressant is a combination of from 2 to 10 weight parts of ammonium octamolybdate and from 5 to 25 weight parts of aluminum trihydrate per 100 weight parts of rigid thermoplastic.

The smoke suppressant compound(s) are incorporated into the reinforcing base component in the compounding step for the sheet compound along with stabilizer, and other optional compound ingredients, such as polymeric impact modifiers. The impact modifiers must be compatible with the resin used but preferably not miscible. Miscibility would likely result in a lowering of the flexural modulus of the sheet. Compatible, but immiscible impact modifiers includable herewith are acrylonitrile- butadiene-styrene terpolymers (ABS) such as available from GE Plastics Inc. under the Blendex trademark, and methacrylate-butadiene-styrene polymer (MBS). Other impact modifiers disclosed in *Plastics compounding*, Nov./Dec., 1983: "Update: Impact Modifiers for Rigid PVC," by Mary C. McMurrer may be used. "Diene" impact modifiers generally contain a rubbery core component polybutadiene, polynorbornadiene, polybutadiene jointly copolymerized with isoprene or alkyl acrylate ester or other comonomer copolymerizable with a diene such as styrene. The rubbery core is generally second stage polymerized with a higher Tg shell composition such as styrene and methyl methacrylate (MBS), acrylonitrile, styrene and methylmethacrylate (MABS). Exemplary MBS types are Paraloid® KM-653, BTA-733 from Rohm and Haas, or Kanegafuchi B-56 and B-22KO. ABS refers generally to polybutadiene jointly graft-copolymerized with acrylonitrile and styrene. Another suitable impact modifier is nitrile rubber blended with SAN (styrene-acrylonitrile); or polybutadiene jointly graft-copolymerized with acrylonitrile and alpha-methyl styrene. Polyolefin copolymers can be used. Impact modifiers based on non-conjugated dienes can be used and include ethylene-propylene-diene rubber, referred herein as EPDM, EPDM graft-copolymerized with vinyl chloride, EPDMs jointly graft-copolymerized with styrene and acrylonitrile. Polyacrylate impact modifiers are most preferred and include lower ($C_4$ to $C_{12}$) acrylate homo, or copolymers, second stage graft-copolymerized with methyl methacrylate, (KM®-323B, KM®-330 Trademark of Rohm and Haas); polybutyl acrylate jointly graft-copolymerized with methyl methacrylate and styrene, poly(ethylhexyl acrylate-co-butyl acrylate) graft polymerized with styrene,and/or acrylonitrile and/or methylmethacrylate; polybutyl acrylate graft polymerized with acrylonitrile and styrene (Blendex® 975, 977, or 979-Trademark of GE Plastics, Inc.). Butyl rubbers graft-copolymerized with vinyl chloride, block copolymers of styrene-butadiene-styrene, radial block copolymers of styrene and butadiene, and styrene-butadiene rubbers could also be used.

Regardless of the particular impact modifier utilized, the amounts thereof can naturally vary, depending upon the desired impact strength as typically measured by an Izod impact test (ASTM D256) within limitations. For polyvinyl chloride based articles there is an upper limit of about 25 weight parts of polymeric impact modifier suggested per 100 weight parts of PVC due to the depressing effect on flexural modulus in the composite, and de-stabilizing effect on melt viscosity during sheet extrusion. The preferred range of amount of polymeric impact modifier is from about 8 to about 20 weight parts per hundred weight parts of polyvinyl chloride.

A stabilizer for the thermoplastic resin is suggested and is necessary especially when using polyvinyl chloride for adequately processing the sheet. The preferred stabilizers for polyvinyl chloride are organotin compounds. Specific examples of organotin stabilizers include alkyl mercaptides such as lower alkyl tin alkyl thioglycolates such as included monomethyltin tris (isooctylthioglycolate), dimethyltin bis (isooctylthioglycolate), monomethyltin tris (2-ethylhexylthioglycolate), dimethyltin bis (2-ethylhexylthioglycolate), monobutyltin tris (isooctylthioglycolate), dibutyltin bis (2-ethylhexylthioglycolate), monomethyltin tris (mercaptoethyltallate), dimethyltin bis (mercaptoethyltallate), dibutyltin bis (mercaptoethyltallate), monobutyltin tris (mercaptoethyllaurate), dibutyltin bis (mercaptoethyllaurate), monomethyltin bis (isooctyl 3-mercaptopropionate), dimethyltin bis (isooctyl 3-mercaptopropionate), dibutyltin bis (isooctyl 3-mercaptopropionate), etc.; alkyltin sulfides such as monomethyltin sulfide, dimethyltin sulfide, monobutyltin sulfide, dibutyltin sulfide, etc.; alkyltin carboxylates such as dimethyltin dilaurate, dibutyltin dilaurate, dibutyltin dioctanoate, dibutyltin didecanoate, dibutyltin neodecanoate, dibutyltin dilaurate, dibutyltin ditallate, dioctyltin maleate, dibutyltin bis (dodecyl maleate), et., and mixtures thereof. Lower alkyl tin alkyl thioglycolates are most preferred. At least 1 and preferably 2 to 5 weight parts per 100 parts PVC of tin stabilizer are sufficient. Commercial embodiments are available from Witco, Inc. under the Mark® trademark.

The sheet material can contain effective amounts generally ranging from 0.5 to about 20 parts by weight per 100 weight parts of thermoplastic material (phr) of one or more lubricants, polymeric processing aids and stabilizers known in the art. For example, various lubricants include fatty acids, metal salts of fatty acids, oxidized polyethylene, paraffin wax, fatty esters, polyol esters and the like. Fatty acids and/or the metal salts are most preferred. Polymeric processing aids include styrene-acrylonitrile copolymers and polyacrylates such as polymethylacrylate-polymethylmethacrylate copolymers commercially available from Atochem, USA or Rohm and Haas, Inc. Polyacrylates are most preferred process aids used in conjunction with polyvinyl chloride.

The most preferred rigidizing embodiment is adapted for reduced smoke emission. Smoke emission can be conveniently measured by specific Smoke Density in both the flaming ($D_m$/g (F)) and non-flaming ($D_m$/g (NF)) modes measured by means of the National Bureau of Standards (NBS) smoke chamber designed to meet ASTM E662-93 test requirements. The maximum optical density as a function of light obscuration per gram of sample is observed with a vertical light path. The preferred rigidizing base component of this invention achieved a smoke density ($D_M$/g) of less than 450, with the more preferred embodiment achieving a smoke density of less than 350 in either the flaming on non-flaming mode.

EXTRUSION OF SHEET

The ingredients comprising the sheet are compounded by conventional means using conventional compounding equipment in batch or continuous manner. The conventional method of extrusion is preferably used to form a flat sheet in a continuous process and the flat sheet is typically cut by guillotine after cooling sufficiently and stacked. A conventional two stage vented extruder equipped with a sheet die can be used.

THERMOFORMING METHOD

The most preferred base component article is made from a single thermoformed, extruded or calendered sheet of rigid glass fiber reinforced polyvinyl chloride. Shaping is accomplished by heating the sheet to the softening point and drawing down onto a male mold or drawing into a female mold cavity. If thermoforming is done with a female mold cavity, a plug can be used in conjunction with vacuum to draw the sheet into the mold. Thermoforming by drawing the sheet down onto a male mold is the most preferred method. With the use of a male mold, vacuum is preferably applied with vacuum holes drilled throughout a hollow male mold pattern as air is drawn from beneath the mold. Alternatively, the method of applying differential pressure can be used if the entire mold is contained within a pressure box. In this method the pressure box is forced by air pressure down over the sheet as it is drawn over the male mold. Optional vacuum assistance within the mold can be applied.

Automated sheet handling means such as a rotary or shuttle platform can be used to move the sheet into and out of the heating oven. A clamp frame is used with such a platform. In the typical thermoforming method, flat sheets are mounted in the clamp frame and sheet is conveyed to the oven. An oven providing heating elements above and below the sheet should be used. The oven temperature suggested is 1000° F. on the top side and 900° F. on the bottom side for a sheet having a thickness of about 0.200 inches. A dwell time of approximately 3 minutes is suggested. The dwell time will vary according to the sheet thickness and the distance of the heating elements from the sheet surface. The most preferred indexing method indicating the proper softening point is the use of an electric eye which indicates an established level of sag in the sheet. When the sheet has reached the proper sag, the clamp frame is shuttled from the oven to the position over the male mold wherein the clamp frame is lowered forcing the sheet over the mold. The edge of the sheet at the clamp frame forms the sealing surface just outside the flange region and vacuum is drawn. After applying vacuum, the sheet is allowed to cool below its heat distortion temperature before removal from the clamp frame and mold. Excess is trimmed preferably leaving flange 6. The resulting thickness draw-down ratio of the shaped rigidizing component can vary from about 1:1 to about 1:3 in various regions of the article. The highest draw-down ratio to provide sufficient rigidity should depend on the starting sheet thickness and the flexural modulus of the thermoplastic material used. A draw-down thickness in the sidewall area of the rigidizer should not be less than 0.060 inches for a material having a flexural modulus of from about $1\times10^6$ p.s.i. to about $1.3\times10^6$ p.s.i. The minimum sidewall thickness acceptable is about 0.090 inches for a rigid thermoplastic material exhibiting a flexural modulus of about 300,000 psi to about 400,000 psi. The minimum sidewall thickness is about 0.080 inches for a rigid thermoplastic material exhibiting a flexural modulus of about 400,000 psi to 700,000 psi. The sidewall region typically experiences the highest draw down. It has been observed that there is a higher degree of draw down in the sidewall for fiber reinforced thermoplastic materials than non-fiber reinforced materials of the same un-drawn thickness.

EXAMPLE

The following example illustrates the most preferred embodiment, the disclosure of which is to be interpreted as illustrative and not limitative. The following listed ingredients except glass were powder mixed followed by melt processing on a commercial sized compounding device equipped with a down stream port for the addition of glass fibers, which were fed at a rate of 20 weight parts per 80 weight parts of compound fed therethrough. The melt processed material was formed into pellets.

| COMPONENTS | WEIGHT PARTS |
|---|---|
| PVC | 100 |
| Process Aid | 4 |
| Polymeric Impact Modifier | 13 |
| Tin Stabilizer | 3 |
| Lubricants | 4 |
| Calcium Carbonate | 5 |
| AOM | 5 |
| Hydrated Alumina | 10 |
| Chopped glass fibers | 20 weight % |

The resulting pellets were then extruded into approximately a 0.200 inch thick sheet followed by pressing individual sample plaques to various thicknesses ranging from 0.050 to 0.215 inches as listed below. The plaques were tested in small scale smoke chamber for measurement of smoke density (Dm/g.) in the flaming (F) and non-flaming (NF) mode under the procedures detailed in ASTM E-662-93. It is preferred that the base component exhibit a smoke density in the flaming and non-flaming mode of 200 to 300 Dm/g. or less with the most preferred level of smoke density of 200 to 250 Dm/g. in the flaming and non-flaming modes. Table 1 illustrates that fiber reinforced polyvinyl chloride containing aluminum and molybdenum will exhibit smoke density of 250 Dm/g. in a thickness range of from 0.060 to 0.150.

TABLE 1

| Sample Thickness Inch (cm) | Mode | Dm/g. Average 2 Trials |
|---|---|---|
| 0.050 | F | 150 |
| | NF | 75 |
| 0.080 | F | 190 |
| | NF | 150 |
| 0.120 | F | 235 |
| | NF | 185 |
| 0.150 | F | 250 |
| | NF | 220 |
| 0.215 | F | 285 |
| | NF | 285 |

A 0.200 inch thick sheet was formed into a rigidizing base component as depicted in reference 2 of FIG. 2 was combined with a plastic sanitaryware article and tested for load deflection according ANSI Z-124.1–1987. Load tests included applying a specified preload weight through a 3 inch diameter weight distribution disk. The floor region was tested with a preload of 300 pounds and the sidewall was tested with a preload of 10 pounds. The deflection in the floor was less than the maximum allowable deflection of 0.150 inches. The deflection in the sidewall was less than the maximum allowable deflection of 0.125 inches.

This disclosure illustrates that rigid thermoplastics can be formed into sheets of the specified thickness and shaped according to the essential design for a cradle and leveler which meets commercially established deflection standards in the sanitaryware industry as one specific application. Furthermore, fiber reinforced rigid polyvinyl chloride will provide sufficient rigidity for sanitaryware structural support and when formulated with effective amounts of smoke suppressant materials disclosed herein, will enable achieving flammability and smoke emission within commercially established limits in a range of thickness which will enable meeting the structural support requirements.

The above preferred embodiments and examples are given to illustrate the scope and spirit of the present invention. These embodiments and examples will make apparent, to those skilled in the art, other embodiments and examples. These other embodiments and examples are within the contemplation of the present invention. Therefore, the present invention should be limited only by the appended claims.

What is claimed is:

1. A shaped, rigid tub or sanitaryware vessel supporting structural article for a vessel, for a vessel said article comprising a cradle, a leveling means for supporting said vessel, and a drain hole said cradle contains a sidewall having a height of at least 12 inches and thickness of at least 0.060 inches, wherein said sidewall terminates in a flange, and wherein said leveling means comprises a plurality of lower contacting regions and upper contacting regions, between said lower and upper contacting regions are defined a plurality of unsupported span regions having the shortest distance between adjacent upper regions (span) of from 2.5 to 6 inches, and wherein the height of the upper contacting region is varied to provide a slope in the direction of said drain hole, wherein said support article comprises a glass fiber reinforced thermoplastic having a flexural modulus of at least 300,000 psi containing 2% to 50% by weight of dispersed short glass fibers having a diameter of from 8 to 25 millimeter and length before use of from 1 to 20 millimeter.

2. The article of claim 1 made from sheet having a thickness before shaping of from 0.06 inch to about 0.300 inch.

3. The article of claim 1 wherein said cradle and leveling means are integrally shaped from a single continuous sheet.

4. The article of claim 1 wherein said cradle contains a smooth, continuous bottom, and said leveling means is formed from a separate sheet and contacts the underside of said cradle.

5. The article of claim 1 wherein said slope ranges from 1/1000 to 1 inch per foot (0.00254 cm to 2.54 cm per 30.5 cm).

6. The article of claim 1 wherein said upper contacting regions and said lower regions are arranged in an alternating, linear pattern, and in the periphery of said floor said upper contacting regions merge with said sidewall.

7. The article of claim 1 wherein said upper contacting regions and said lower contacting regions are arranged in an alternating, concentric circular pattern.

8. The article of claim 1 further comprising a void defining a hole through said article, and floor reinforcing channels in said leveler having a height less than the height of said upper contacting regions.

9. The article of claim 8 wherein said upper contacting region surrounds said void.

10. The article of claim 1 wherein said vessel is in the shape of a bath tub, a spa, a whirlpool, a hot tub, and a shower stall.

11. The article of claim 1 wherein said flange extends outward from said sidewall at least about 1 inch.

12. The article of claim 11 wherein said flange is integral with said sidewall.

13. The article of claim 11 wherein said flange is attached to said sidewall by mechanical fastening means for attachment.

14. The article of claim 3 wherein said sheet after shaping has a draw down in any region of from 1:1 to 1:3.

15. The article of claim 1 wherein said sidewall has a thickness of at least 0.090 inches and wherein said thermoplastic material has a flexural modulus of from 300,000 psi to 400,000 psi.

16. The article of claim 1 wherein said sidewall has a thickness of at least 0.080 inches and wherein said thermoplastic material has a flexural modulus of from 400,000 psi to 700,000 psi.

17. The article of claim 1 made with a thermoplastic material selected from the group consisting of acrylonitrile-butadiene-styrene copolymers, styrene-acrylonitrile copolymer, acrylonitrile-styrene-methacrylate copolymers, polystyrene, styrene-alpha methyl styrene copolymers, polyethylene, polypropylene, polycarbonate, polyvinyl chloride, chlorinated polyvinyl chloride, styrene maleic anhydride, polybutylene terephthlate, and nylon.

18. The article of claim 17 wherein said thermoplastic material contains glass fibers having a diameter of from about 8 to 25 microns and length before use of from 1 to 20 mm.

19. The article of claim 1 wherein said thermoplastic material is polyvinyl chloride having a molecular weight according to ASTM D1925 of from 0.45 to 0.8, and wherein said thermoplastic material contains glass fibers having a diameter of from 8 to 25 μm and a length before incorporation of from 1 to 20 mm.

20. The article of claim 17 further comprising at least one additive selected from the group consisting of molybdenum, iron, copper, zinc, vanadium, lithium, sodium, potassium, magnesium, calcium, barium, zirconium, manganese, antimony, phosphorous, aluminum, chromium, boron, tin, titanium and mixtures thereof.

21. The article of claim 20 wherein said thermoplastic material is polyvinyl chloride having a molecular weight according to ASTM D1925 of from 0.45 to 0.8, and wherein said thermoplastic material contains glass fibers having a diameter of from 8 to 25 μm and a length before incorporation of from 1 to 20 mm.

22. The article of claim 21 wherein said thermoplastic material contains from 10% to 25% by weight glass fibers having a diameter of from about 10 to 13 microns and length before use of from 1 to 8 mm.

23. The article of claim 20 wherein said at least one additive is selected from the group consisting of CuS, $Cu_2S$, $Cu_3N$, $SnS_2$, $MoB_2$, FeS, $Cr_2S_3$, TiB, $AlB_{12}$, $Mg(OH)_2$, $2ZnO{\cdot}3B_2O_3{\cdot}3.5H_2O$, zinc borate, $Al_2O_3{\cdot}3H_2O$, $Sb_2O_3$, $K_2MoO_4$, $Li_2MoO_4$, $BaMoO_4$, $MoO_2$, $MoO_3$, $Mo_2O_5$, $Mo_2O_3$, $MoS_2$, $MoS_3$, $MoS_4$, ZnO/MgO, ZnO/MgO/CaO, $Na_2Sb_2O_6{\cdot}5H_2O$, $NaSbO_3$, $Sb_2O_3$, halo-substituted alkyl phosphates, $[(NH_4)_2MoO_7]$; $[(NH_4)_6MoO_7O_{24}{\cdot}4H_2O]$; $[(NH_4)_4Mo_8O_{26}]$; $[(NH_4)_2Mo_{10}O_{31}]$; $[Na_2MoO_4]$; $[CaMoO_4]$; $[ZnMoO_4]$ sodium molybdate, potassium molybdate, barium molybdate, lithium molybdate, calcium molybdate, cadmium molybdate, molybdenum carbonyl, molybdenum disulfide, ammonium paramolybdate, dimeric ammonium 5-molybdocobaltate, ammonium 6-molybocobaltate, ammonium 9-molybdonickelate, ammonium 6-molydonickelate, ammonium 6-molybdoaluminate, ammonium 6-molybdochromate, ammonium 6-molybdoferrate, and moldybdenyl acetylacetonate.

24. The article of claim 21 further comprising an amine molybdate.

25. The article of claim 24 wherein said amine molybdate is selected from the group consisting of aliphatic, alicyclic, aralkyl, alkaryl, aromatic, and heterocyclic amines containing from 1 to 40 carbon atoms and from 1 to 10 primary, secondary and tertiary amine groups.

26. The article of claim 17 further comprising hydrated alumina.

27. The article of claim 26 further comprising calcium carbonate.

28. The article of claim 19 further comprising a lubricant, a polymeric processing aid, and wherein said stabilizer is an organotin stabilizer.

29. The article of claim 17 further comprising a polymeric impact modifier present at from 8 to 15 weight parts per hundred weight parts of said polyvinyl chloride.

30. The article of claim 20 exhibiting a specific smoke density in both the flaming and non-flaming modes according ASTM E662 of less than 450 $D_m$/g.

31. The article of claim 30 exhibiting a specific smoke density in both the flamming and non-flamming modes according ASTM E662 of less than 300 $D_m$/g.

* * * * *